United States Patent [19]

Milocco

[11] Patent Number: 4,732,171

[45] Date of Patent: Mar. 22, 1988

[54] DISHWASHING MACHINE WITH SINGLE CONTROL OF ADDITIVE DISTRIBUTION AND WATER SOFTENER REGENERATION

[75] Inventor: Claudio Milocco, Pordenone, Italy

[73] Assignee: Industrie Zanussi S.p.A., Pordenone, Italy

[21] Appl. No.: 35,724

[22] Filed: Apr. 8, 1987

[30] Foreign Application Priority Data

Apr. 17, 1986 [IT] Italy ..... 45720 A/86

[51] Int. Cl.[4] ..... B08B 3/02; B08B 13/00

[52] U.S. Cl. ..... 134/57 D; 134/95; 134/98; 137/624.18; 222/651

[58] Field of Search ..... 134/57 D, 95, 98; 68/12 R, 17, 207; 137/624.18; 222/651

[56] References Cited

U.S. PATENT DOCUMENTS 4,402,197 9/1983 Groult et al. ..... 134/57 D X
4,481,086 11/1984 Bianchi et al. ..... 134/57 D X

FOREIGN PATENT DOCUMENTS 0022911 1/1981 European Pat. Off. .
0152154 8/1985 European Pat. Off. ..... 134/57 D
3304037 7/1984 Fed. Rep. of Germany .
67094 A/80 1/1980 Italy .
2063658 6/1981 United Kingdom .

*Primary Examiner*—Philip R. Coe
*Attorney, Agent, or Firm*—Wenderoth, Lind & Ponack

[57] ABSTRACT

A dishwashing machine includes at least one additive distributor for dispensing additive into a wash tub, a first electrically controlled actuator for operating the distributor, a water softener for softening water supplied to the wash tub, a regeneration circuit for regenerating the water softener, a second electrically controlled actuator for operating the regenerating circuit, and a programmer for controlling the operation of the first and second actuators. The first and second actuators are electrically connected in parallel to each other. A single switch is controlled by the programmer for connecting the parallelly connected first and second actuators to a power source for at least one first time period and at least one second time period longer than the first time period. The first and second actuators have response times respectively shorter and longer than the first time period, and the response time of the second actuator is less than the second time period.

2 Claims, 1 Drawing Figure

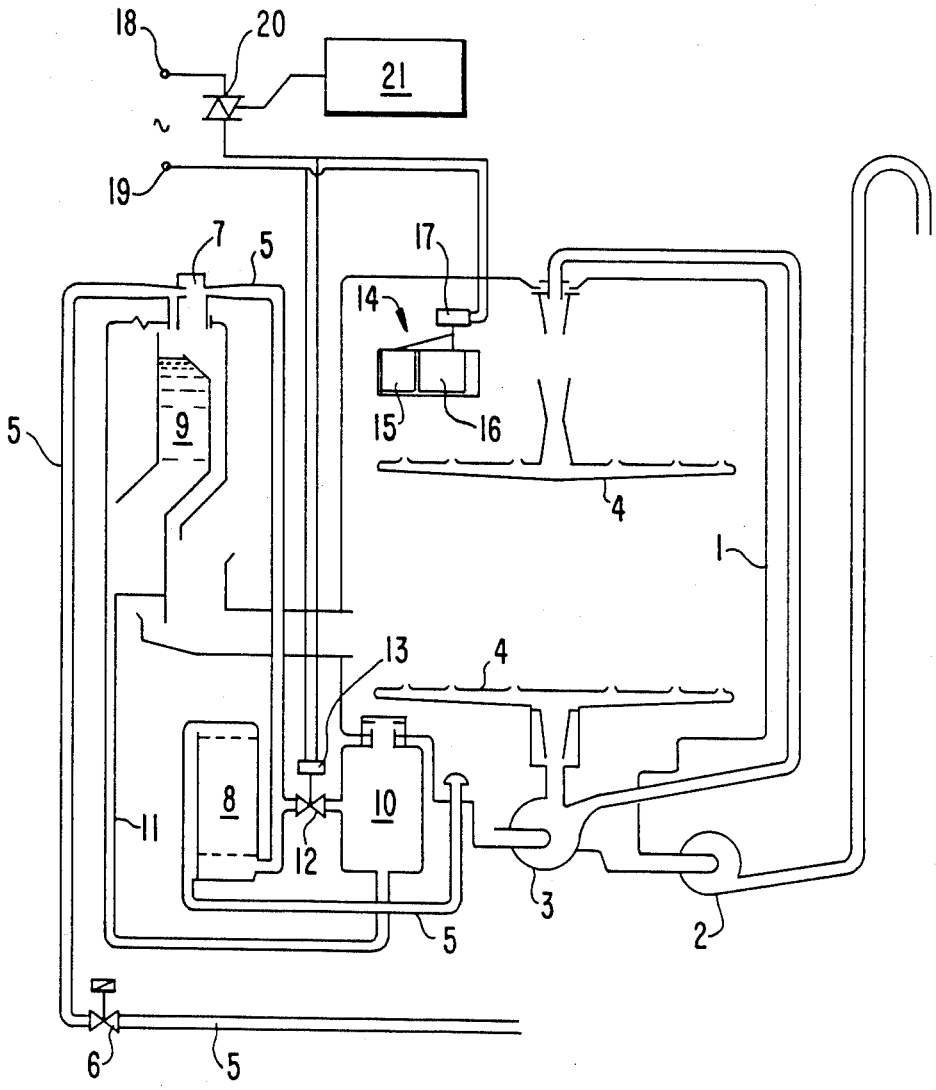
18
20
21
19
7
5
17
14
15
16
9
5
4
1
13
4
8
10
11
12
3
2
5
6
5

DISHWASHING MACHINE WITH SINGLE CONTROL OF ADDITIVE DISTRIBUTION AND WATER SOFTENER REGENERATION

BACKGROUND OF THE INVENTION

The present invention relates to an automatic dishwashing machine, particularly of the domestic type, provided with a detergent distributor and a distributor for another additive, such as a brightener or bleach, and additionally provided with a water softener as well as a hydraulic circuit for the regeneration of the water softener. As is known, this type of water softener basically includes a decalcifier having ion exchange resins through which passes water to be supplied to the wash tub of the machine. The ion exchange resins of such a decalcifier periodically must be regenerated, for example with a brine solution. For such purpose, the decalcifier is connected by means of a control valve to a salt container to be supplied with a metered quantity of regeneration water.

The admission of detergent to the wash tub, the delivery of the brightener thereto and the regeneration of the decalcifier are effected at different times and for different periods during the cycle of operation of the dishwashing machine. Accordingly, it is necessary to provide a plurality of different actuators controlled by respective controls, for example electrical controls, which in turn are controlled by the programmer of the machine. Thereby, suitable control of the operation of the distributors and the regeneration valve is achieved.

In order to reduce the number of actuators and to increase their reliability, it has been proposed to provide a single distributor for the detergent and additives, that is an integrated distributor provided in a single supporting body and operated by a single actuator. One such arrangement is disclosed in German DE-OS No. 33 04 037. Particularly, by the use of a single memory mechanism, this distributor delivers a metered quantity of brightener, such as bleach, only after a closing gate of a compartment capable of accommodating a dosage of detergent has been opened.

However, even with this type of distributor, the dishwashing machine nevertheless must be provided with respective switches for controlling separately the actuators responsible for the operation of the distributor and for carrying out the regeneration of the decalcifier.

SUMMARY OF THE INVENTION

Accordingly, it is the object of the present invention to provide an improved dishwashing machine of the above type wherein it is possible to employ a single control element for controlling selectively, by means of a minimum number of actuators, the delivery of detergent to the wash tub, the delivery of other additives thereto, as well as the regeneration of the water softener.

This object is achieved in accordance with the present invention by the provision of a dishwashing machine including at least one additive distributor for dispensing at least one dishwashing additive, for example detergent, brightener, etc., into a wash tub, a first electrically controlled actuator for operating the distributor, a water softener for softening water supplied to the wash tub, regeneration means for regenerating the water softener, a second electrically controlled actuator for operating the regeneration means, and a programmer for controlling the operation of the machine including the first and second actuators. In particular accordance with the present invention, the first and second actuators are electrically connected in parallel to each other. A single switch is controlled by the programmer and connects the parallelly connected first and second actuators to a power source for at least one first time period and at least one second time period longer than the first time period. The first and second actuators have response times respectively shorter and longer than the first time period, such that the operation of the single switch by the programmer for the first time period will operate the first actuator to dispense the at least one additive but will not operate the second actuator to regenerate the water softener. On the other hand, the response time of the second actuator is less than the second time period, such that operation of the single switch by the programmer for the second time period will operate the second actuator to regenerate the water softener.

Accordingly, by appropriately designing the programmer, in a manner generally known in the art, it is possible to control selectively the various actuators for the regeneration of the decalcifier and for controlling the distribution of the various additives by means of a single control element. This makes it possible to improve the reliability of the dishwashing machine.

BRIEF DESCRIPTION OF THE DRAWING

Other objects, features and advantages of the present invention will be apparent from the following detailed description of a preferred and nonlimiting embodiment thereof, with reference to the accompanying drawing, wherein:

The single FIGURE is a schematic view of one embodiment of a dishwashing machine according to the present invention.

DETAILED DESCRIPTION OF THE INVENTION

The drawing illustrates schematically a dishwashing machine including a wash tub 1. At the bottom of tub 1 is provided a sump for collecting washing liquid which may be pumped by a drain pump 2 to a discharge line during a draining phase of the cycle of operation of the machine. Also illustrated is a recirculation pump 3 operable during a washing phase of the cycle of operation of the machine to supply washing liquid from the bottom of tub 1 to sprinkling vanes 4. These features of the dishwashing machine are conventional.

The wash tub 1 is supplied with water from a water main via a supply conduit 5 in which are arranged in series a charging valve 6, an air break 7 and a water softener such as a decalcifier 8. The end portion of conduit 5 may be formed in the manner disclosed in European Patent Application EP-B No. 0,022,911. These features in themselves are conventional.

The dishwashing machine also has a circuit for regeneration of the active substances, for example ion exchange resins, of decalcifier 8. Such circuit includes a metering reservoir 9 and a salt (or other regenerating substance) container 10. Reservoir 9 and air break 7 may be, for example, as disclosed in British Patent Application GB-B No. 2,063,658. In particular, the bottom of reservoir 9 is connected to the decalcifier 8 through a regeneration conduit 11 in which are arranged in series the salt container 10 and a valve 12 operated by an electrically controlled actuator 13. Suitably mounted on the dishwashing machine, for example in a charging door thereof (not shown) is provided a distributor 14 for the supply of additives, such as a detergent and a brightener, to the wash tub. It is contemplated that distributor 14 may be constructed in the manner disclosed in the above German DE-OS No. 33 04 037. Thus, distributor 14 includes a compartment 15 for a dosage of detergent and provided with a closing gate, as well as a brightener distributor 16. The gate of compartment 15 is adapted to be opened by an actuator 17, for example an electromagnet or a thermistor device, when actuator 17 receives a brief control pulse, for example having a maximum duration of several seconds. Distributor 16 is adapted to deliver a metered quantity of the additional additive, for example brightener, by the operation of actuator 17, but only when the latter receives a brief control pulse after the gate of compartment 15 already has been opened.

In particular accordance with the novel features of the present invention, the actuators 13, 17 are operated by a single control element. More particularly, actuators 13, 17 (the construction of which would well be understood by one skilled in the art) are electrically connected in parallel to each other as illustrated in the drawing, and are connected across the terminals 18, 19 of an electric power supply by means of a single switch 20 (preferably of the electronic type as would be understood by one skilled in the art) operated by a programmer 21 of the dishwashing machine.

Actuator 13 is of the type having a delayed response time, and can be as disclosed in Italian Patent Application No. 67094 A/80 filed Jan. 23, 1980.

The single switch 20 is controlled by programmer 21 and is connected in series with each of the parallel circuits of the actuators 13, 17. Switch 20 is capable of predetermined operation by programmer 21 to connected the actuators 13, 17 to the power source for at least one first time period of relatively short duration and at least one second time period of relatively long duration. It is contemplated that actuators 13, 17 have response times respectively longer and shorter than the first time period of relatively short duration. Thus, operation or closing of single switch 20 by programmer 21 for the first time period of relatively short duration will operate actuator 17, but will not operate actuator 13 which has a response time longer than such relatively short first time period. On the other hand, operation or closing of single switch 20 by programmer 21 for the second time period of relatively long duration will cause actuator 13 to regenerate the water softener.

Accordingly, it will be apparent that by initiating in a manner known per se the operating times and time periods of programmer 21, it is possible to determine the selective operations of distributor 14 and regeneration valve 12.

Programmer 21 controls in a traditional manner not described herein all of the operating elements of the dishwashing machine. Considering only the operating phases of the dishwashing machine pertinent to the present invention, after a suitable quantity of water has been supplied to wash tub 1, reservoir 9 contains a metered quantity of regeneration water from conduit 5. At this point, the programmer starts a washing phase of the machine, during which recirculation pump 3 is operated and switch 20 is closed for the first time period of relatively short duration, for example several seconds less than the response time of actuator 13. Accordingly, only actuator 17 is operated which causes compartment 15 of distributor 14 to open, thereby resulting in distribution of a previously charged detergent dose into tub 1. During a final phase of the operating cycle of the dishwashing machine, programmer 21 again causes switch 20 to open for a brief time period, shorter than the response time of actuator 13, resulting in the delivery of a dosage of another additive, for example brightener, from distributor 16 into the wash tub.

Thereafter, programmer 21 then causes switch 20 to close for the second time period of relatively long duration, for example several minutes, and longer than the response time of actuator 13. Thereby, valve 12 is opened and regeneration of water softener 8 is achieved in a previously known manner. On the other hand, the closing of switch 20 for the time period of long duration and the resultant excitation of actuator 17 will produce no effect on distributor 14, since such distributor previously was emptied. In a known manner, the opening of valve 12 causes water from reservoir to flow by gravity through conduit 11, salt container 10 and valve 12, thus regenerating water softener 8.

It is to be understood that the periods of closing of single switch 20 can be determined by programmer 21 to be at times other than those discussed above, and the particular sequence does not form a portion of the present invention. For example, the start of the regeneration phase may occur at the beginning of the cycle of operation of the washing machine, concurrently with the delivery of detergent from compartment 15 of distributor 14. Alternatively, the regeneration operation could be started simultaneously with the delivery of brightener from distributor 16. In any case, it is sufficient that programmer 21 closes single switch 20 for a time interval longer than the response time of actuator 13 to thereby open valve 12 to regenerate the water softener. In must be kept in mind that the volume of water collected in reservoir 9 should be lower than or equal to the volume of water softener 8 so that (as is known) during the regeneration operation (at whatever time during the cycle of operation of the dishwashing machine), excess brine is not caused to enter wash tub 1.

Although the present invention has been described and illustrated with respect to preferred features thereof, it is to be understood that various modifications and changes may be made to the specifically described and illustrated features without departing from the scope of the present invention. For example, it is contemplated that distributors 15, 16 may be separate elements, each provided with an associated actuator 17 connected in parallel to other actuators and having response times shorter than the response time of actuator 13.

I claim:

1. In a dishwashing machine including at least one additive distributor for dispensing at least one dishwashing additive into a wash tub, a first electrically controlled actuator for operating said distributor, a water softener for softening water supplied to the wash tub, regeneration means for regenerating said water softener, a second electrically controlled actuator for operating said regeneration means, and programmer means for controlling the operation of said machine including said first and second actuators, the improvement comprising:

said first and second actuators being electrically connected in parallel to each other;

single switch means, controlled by said programmer means, for connecting the parallelly connected first and second actuators to a power source for at least one first time period and at least one second time period longer than said first time period; and said first and second actuators having response times respectively shorter and longer than said first time period, such that operation of said single switch means by said programmer means for said first time period will operate said first actuator to dispense said at least one additive but will not operate said second actuator to regenerate said water softener.

2. The improvement claimed in claim 1, wherein said response time of said second actuator is less than said second time period, such that operation of said single switch means by said programmer means for said second time period will operate said second actuator to regenerate said water softener.

* * * * *